United States Patent [19]

Sato et al.

[11] 3,933,477

[45] *Jan. 20, 1976

[54] METHOD OF PRODUCING FERRO-NICKEL OR METALLIC NICKEL

[75] Inventors: Yohta Sato, Tokyo; Masakata Matsuda; Yukio Ohi, both of Miyazu; Toyomi Matsumori, Miyazu, all of Japan

[73] Assignee: Nippon Yakin Kogyo Company Limited, Tokyo, Japan

[ * ] Notice: The portion of the term of this patent subsequent to Oct. 16, 1990, has been disclaimed.

[22] Filed: July 5, 1973

[21] Appl. No.: 376,403

Related U.S. Application Data

[63] Continuation-in-part of Ser. No. 40,545, May 26, 1970, Pat. No. 3,765,873.

[30] Foreign Application Priority Data

Feb. 2, 1970 Japan ..... 45-8428
Feb. 9, 1970 Japan ..... 45-10906

[52] U.S. Cl. ..... 75/82
[51] Int. Cl.[2] ..... C22B 23/06

[58] Field of Search ..... 75/82

[56] References Cited

UNITED STATES PATENTS

| | | | |
|---|---|---|---|
| 3,503,734 | 3/1970 | Bell | 75/82 |
| 3,656,935 | 4/1972 | Iwasaki | 75/82 |
| 3,765,873 | 10/1973 | Sato et al. | 75/82 |
| R26,042 | 6/1966 | Grebe et al. | 75/82 |

*Primary Examiner*—M. J. Andrews
*Attorney, Agent, or Firm*—Fleit & Jacobson

[57] ABSTRACT

A method of making ferro-nickel or metallic nickel from iron-rich nickel ore by adding silica therein, so as to form difficultly reducible fayalite with iron in the ore, adding a carboneous reducing agent therein, and heating the mixture without melting the same at 900°C to 1,300°C in a reducing atmosphere having a $$\frac{CO}{CO + CO_2}$$

ratio of 1.6% to 90%.

8 Claims, 12 Drawing Figures

METHOD OF PRODUCING FERRO-NICKEL OR METALLIC NICKEL

This application is a continuation-in-part application of U.S. patent application No. 40,545 which was originally filed on May 26, 1970 now U.S. Pat. No. 3,765,873.

BACKGROUND OF THE INVENTION

1. Field of the Invention:

This invention relates to a method of producing ferro-nickel or metallic nickel, and more particularly to a method of producing ferro-nickel or metallic nickel from iron-rich nickel ore or iron-rich nickel oxide by adding separately prepared silica to the starting material.

2. Description of the Prior Art

Nickel is an indispensable metal for making stainless steel and heat-resisting alloy. As the consumption of nickel increases, the availability of high grade nickel ores gradually decreases, and there has been an increasing need for a process of making nickel from comparatively low grade ores, such as laterite, containing a large amount of iron, as shown in Table 1. There have been a number of studies made heretofore on the process of producing ferro-nickel from iron-rich nickel ore. Among such studies, the nickel-preferred reduction is most important.

What is meant by the "nickel-preferred reduction" is based on the difference in the thermodynamic properties of nickel and iron; namely, iron has a greater affinity for oxygen than has nickel. In an actual refining process for the reduction of iron-rich nickel ore, such as laterite, however, iron and nickel are simultaneously reduced, and it is very difficult to give preference to the reduction of nickel over that of iron. More particularly, when iron-rich nickel ore is reduced in a conditioned gaseous atmosphere, both nickel and iron are simultaneously formed by reduction, and the resultant ferro-nickel has a comparatively low nickel content. It has been difficult to improve the nickel content in the ferro-nickel by any further treatment.

The inventors have noticed the fact that iron contained in iron-rich nickel ores can be fixed in the form of difficultly reducible fayalite, so that the selective reduction of nickel can be effected based on the difference of the reducibility between fayalite and nickel compound.

The formation and decomposition of fayalite ($2FeO.SiO_2$) can be represented by the following chemical formulae.

$$2Fe_3O_4 + 3SiO_2 + 2CO \rightarrow 3(2FeO.SiO_2) + 2CO_2 \quad (1)$$

$$2FeO.SiO_2 + 2CO \rightarrow 2Fe + SiO_2 + 2CO_2 \quad (2)$$

The formation of fayalite according to the formula (1) takes place already in an atmosphere with carbon-monoxide content $$\left(\frac{CO}{CO + CO_2}\right)$$

of 1.6% or more, while the decomposition of fayalite according to the formula (2when the carbon-monoxide content is up to 90%. Accordingly, if the iron component of the nickel ore is fixed in the form of fayalite by reaction formula (1), the reduction of nickel can be selectively effected while suppressing the reduction of iron.

Therefore, an object of the present invention is to provide a method for producing ferro-nickel or metallic nickel from iron-rich nickel ores by adding silica so as to positively use the formation lof fayalite for the selective reduction of nickel.

U.S. Pat. No. 2,767,075, which was granted to Albert E. Greene on Oct. 16, 1956, discloses a process of direct reduction of an iron ore containing nickel, in which it was intended to hold oxide of iron as an iron oxide silicate against reduction. To this end, Greene uses fluxing material which is to slag oxide material including oxide of iron. Greene, however, does not suggest the effective use of fayalite, due to the following reasons.

a. Greene uses a molten metal bath on which a starting charge is placed. As a result, the starting charge including the nickel-containing material and silica-containing fluxing material is susceptible to melting. Once the starting charge is molten, the chemical reaction of the aforesaid equation (1) will not take place. It is generally believed that, when melted, fayalite is ionized, as given by the equation of $2Fe.SiO_2 \rightarrow 2Fe^{++} + O^{--} + SiO_2$. As soon as being ionized, the desired difficultly reducible nature of the slag is lost, and the efficiency of the selective reduction is greatly deteriorated.

b. The inventors of the present application have found that the formation of the fayalite is carried only in solid state, and the reaction of the fayalite formation is very low. The fact of solid state reaction may be one of the reasons for the slowness of the fayalite formation. With the arrangement of Greene, the starting charge may easily be intermingled with the molten bath, so that the ingredients of the starting charge cannot be held in the solid state for a sufficiently long period of time for effecting the selective reduction.

c. Greene succeeded in producing "a direct nickel-iron containing approximately 6% of nickel" (column 2, lines 52–53). Such nickel content in the nickel iron is unduly low for any practical processes which effectively utilize fayalite. More particularly, the so-called Strategic-Udy process based on the selective use of carboneous reductants without any fayalite can produce a ferro-nickel containing 21.22% of nickel, as disclosed by Marvin J. Udy and Murray C. Udy in Journal of Metals, May 1959 page 312. In other words, when the starting charge of Greene was placed on the molten bath, the reduction of the starting ore was mostly carried out by the so-called "selective reduction with controlled carboneous reductants", rather than by utilizing the presence of fayalite.

d. Greene suggests the use of an electric furnace for carrying out his process. It is not necessarily economical to heat the starting charge by the comparatively expensive electric energy. For instance, iron ores and nickel ores as delivered usually have a large amount of water of crystallization and moisture attached thereto. Removal of the water of crystallization and moisture by electric energy may become unreasonably costly.

To overcome the aforesaid difficulties of conventional methods, the inventors have carried out a series of studies and tests. As a result, a new method of reducing iron-rich starting material containing nickel is provided.

SUMMARY OF THE INVENTION

According to the present invention, there is provided a method for refining nickel by reducing iron-rich starting material containing nickel, comprising steps of mixing the starting material with silica and carboneous reducing agent in a rotary reaction vessel, forming a reducing atmosphere in the vessel by heating the mixture so as to produce carbon dioxide and carbon monoxide at a ratio of $$\left(\frac{CO}{CO + CO_2}\right)$$

of 1.6% to 90%, and firing the mixture at 900°C to 1,300°C without melting the mixture, while causing the iron in the starting material to be compounded with the silica in the form of difficultly reducible fayalite for selectively reducing the nickel-containing material into crude nickel.

The inventors have also found out that the formation of difficultly reducible fayalite in the aforesaid method can be accelerated by adding 0.5% to 5% of sodium carbonate and/or sodium chloride in the starting mixture.

As a source of silica in the process of the present invention, it is possible to use nickel ores having a high silica-content, such as garnierite having a chemical composition as shown in Table 1.

Table I

| Ore | Chemical composition (%) $SiO_2$ | Fe | CaO | MgO | Ni | $Al_2O_3$ | $Cr_2O_3$ |
|---|---|---|---|---|---|---|---|
| Garnierite ore | 35–50 | 9.0–15 | 0.1–0.3 | 20–30 | More than 2.0 | 0.5–1.0 | 0.5–1.5 |
| Laterite ore | Less than 5 | More than 40 | Less than 0.5 | Less than 5 | More than 0.5 | 3–10 | More than 2 |

However, most silica-rich nickel ores contain a large amount of magnesia, for instance, 20–30% of magnesia in the case of garnierite, as shown in Table 1. The chemical behavior of such magnesia in the nickel ore during any wet nickel refining process is similar to that of nickel oxide. Accordingly, the presence of magnesia is detrimental to the wet nickel refining process. It is also known that the presence of a large amount of magnesia is not desirable in dry nickel refining processes, such as the Krupp-Renn's process. After years of study, the inventors have succeeded in developing an improved nickel refining process from both iron-rich ore (e.g., laterite) and nickel magnesium silicate ore (e.g., garnierite), in which magnesia in the nickel magnesium silicate ore is extracted by using carbon dioxide gas, and the residue from the magnesia extraction is used as the silica source for the formation of fayalite in the refining process of the iron-rich nickel ore. The nickel refining method of the present invention has the following advantages.

1. Ferro-nickel or metallic nickel of high grade can be achieved, because reduction is accelerated for both nickel in iron-rich nickel ore and nickel in the residue from magnesia separation of nickel magnesium silicate ore.

2. The carbon dioxide in the exhaust gas from the reduction of both iron-rich nickel ore and the residue from the magnesia separation of nickel magnesium silicate ore can be used for the extraction of magnesia from the nickel magnesium silicate ore, so that the overall heat efficiency of the process is improved.

BRIEF DESCRIPTION OF THE DRAWING

For a better understanding of the invention, reference is made to the accompanying drawings, in which.

FIG.. 1 is a flow diagram of an embodiment of a nickel refining process according to the present invention.

DESCRIPTION OF THE PREFERRED EMBODIMENTS

Figure 5:
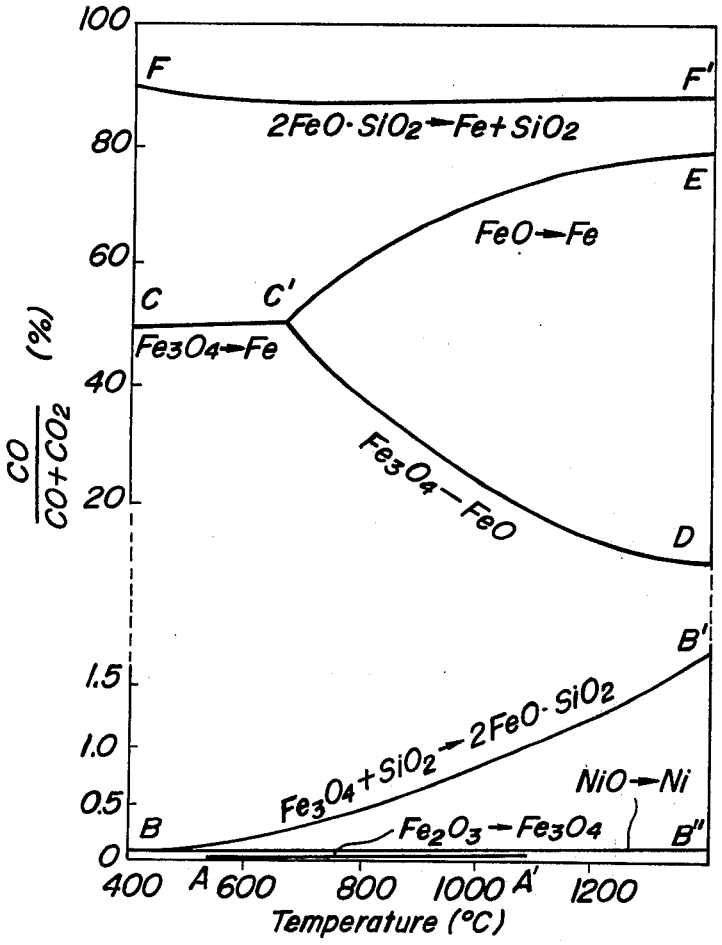
FIG. 5 is an equilibrium diagram for reducing reactions in an $Fe—SiO_2—C—O_2$ system.

The principles of the present invention will be described, referring to an equilibrium diagram of reducing reactions in an $Fe—SiO_2—C—O$ system, or an iron ore reducing system, as shown in FIG. 5. Laterite and garnierite contain iron in the form of limonite ($Fe_2O_3.nH_2O$). The limonite releases its water of crystallization at about 300°C to 350°C and becomes ferric oxide $Fe_2O_3$. The ferric oxide $Fe_2O_3$ can easily be reduced by carbon monoxide to produce $Fe_3O_4$ according to the following chemical reaction. The concentration of carbon monoxide in the gas for the last mentioned reduction can be low.

$$3Fe_2O_3 + CO \rightarrow 2Fe_3O_4 + CO_2 \quad (3)$$

This reduction is represented by the line A—A′ in FIG. 5.

If silica is present in the above reduction system, $Fe_3O_4$ thus produced reacts with the silica ($SiO_2$), so as to form fayalite ($2FeO.SiO_2$), according to the following chemical reaction, as shown by the line B–B′ in FIG. 5.

$$2Fe_3O_4 + 3SiO_2 + 5CO \rightarrow 3(2FeO.SiO_2) + 5CO_2 \quad (4)$$

The minimum content of carbon monoxide in the reducing atmosphere for the production of fayalite is at least 1.6% at 400°C to 1,400°C, and fayalite can easily be formed without regulating the reducing atmosphere.

If, however, there is no silica available for the reducing reaction of the formula (4), $Fe_3O_4$ generated by the reduction (3) is further reduced to FeO or Fe, as shown by the line C–C′–D in FIG. 5, and FeO is further reduced to metallic iron, as shown by the line C′–E of FIG. 5.

On the other hand, fayalite ($2FeO.SiO_2$), which can be formed by the presence of silica and a comparatively low content of carbon monoxide, cannot be reduced unless the content of carbon monoxide in the reducing atmosphere is much higher than that required for the reduction of simple iron oxide. More particularly, the reducing of fayalite to metallic iron takes place only when the content of carbon monoxide in the reducing atmosphere is 90% or higher, as shown by the line F–F′ of FIG. 5.

Accordingly, in treating iron-rich ore and iron-rich nickel oxide, such as laterite, it is possible to suppress the reduction of iron oxide in a reducing atmosphere by adding silica. In other words, silica can be used as a kind of fixer for stabilizing iron in the reducing atmosphere.

It is an important feature of the present invention to form fayalite intentionally by adding silica. In fact, the formation of fayalite has heretofore been avoided in the art of iron manufacture. Contrary to such conventional practice in iron manufacturing industries, the present invention intends to take advantage of the fayalite formation for accelerating the nickel reduction while suppressing the iron reduction.

Due care should be given to the chemical behavior of nickel in the presence of silica in a reducing atmosphere. A compound of nickel oxide and silica has been known, which is referred to as nickel olivine ($2NiO.SiO_2$). If nickel olivine should be formed in the process according to the present invention, the presence of silica will become detrimental to the nickel refining, because nickel olivine is hardly reducible.

The inventors have confirmed that the method of the invention is free from such formation of nickel olivine. If fact, tests were made by adding silica and silica-containing residue, to be referred to hereinafter, in laterite ore from New Caledonia. The mixture of the ore and silica thus added was reduced by heating it at 600°C to 1,200°C. It was found by such tests that the silica thus added was effective in suppressing the reduction of iron but not the reduction of nickel. The reduction of nickel was actually improved in the case of using the silica-containing residue by the presence of the silica.

The freedom of the method of the present invention from the formation of nickel olivine seems to be in the fact that, in the case of iron-rich nickel ores, such as laterite, metallic nickel being reduced tends to melt in metallic iron, and the activity of the nickel in the reducing system is so reduced that nickel olivine is not formed despite the presence of silica. When the silica-containing residue made from nickel magnesium silicate ore is used, the crystal structure of the residue is broken by the formation of fayalite, so as to accelerate the reduction of nickel.

The chemical composition of laterite ores varies, depending on where they are produced. Typical composition of laterites currently available in Japan is shown in Table 1.

It should be noted here that the content of carbon monoxide in the reducing atmosphere necessary for the formation of fayalite is very wide, being 1.6% to 90%, as shown in FIG. 5. Such wideness of the content of carbon monoxide is very important for practising the present invention. Due to such wideness, the operation of the reducing furnace and the regulation of the reducing atmosphere are greatly simplified, and various kinds of reducing agents in solid, liquid, and gas phase can be used, such as coke, coal, natural coke, hydrocarbon gas, carbon monoxide gas, and natural gas, etc.

The content of carbon monoxide in the reducing atmosphere, which is necessary for the reduction of nickel according to the present invention, should be within the range above the line B–B′ of FIG. 5. Theoretically, such range of carbon monoxide content (B–B″) is below the lower limit of carbon monoxide for fayalite formation in the reducing atmosphere (B–B″), and there is no difficulty in preparing it. The silica to be used in the method of the invention for fixing iron in the laterite can be either pure silica or silica-containing ores. Natural silica and mountain sand are most commonly used for such purposes.

The silicate ores to be used as the source of silica in the method according to the present invention, for fixing iron, may sometimes contain magnesia (MgO). This magnesia reacts with $SiO_2$ to form forsterite, which is a substituted compound similar to fayalite. The forsterite thus generated may form a solid solution together with fayalite, which is known as forsterite-fayalite. Accordingly, if magnesia is present in the silica source, fayalite may not be generated as a simple compound, but it often takes the form of a solid solution of forsterite-fayalite. Thus, the iron compound to be formed in the method of the present invention for controlling the reduction of iron is not restricted to fayalite alone, but it may include solid solutions of fayalite with other compounds, such as forsterite-fayalite solid solution.

In the foregoing description, laterite is used as the iron-rich nickel ore for producing ferro-nickel or metallic nickel according to the present invention. The starting material of the method of the present invention, however, is not restricted to laterite alone, but any other iron-rich nickel ores may be used, such as garnierite and iron enriched garnierite. Furthermore, any nickel oxides with high iron-content may also be used as the starting material of the method of the invention, even when such compounds are not in the form of ore.

As pointed out in the foregoing, one of the important features of the present invention is in the use of nickel magnesium silicate ore, e.g., garnierite, as the silica source after separating magnesia therefrom. Such process will now be described in detail, referring to the flow diagram of FIG. 1. The ore to be used as the silica source, such as garnierite, is at first crushed to the grain size suitable for the next following step of calcination, which grain size is usually about 150 $\mu$ or finer.

The ore thus crushed is calcined at about 500°C to 800°C, to remove the water of crystallization in the ore, for separating gangue component (MgO) by decomposing the crystal structure of magnesium silicate. A slurry was made by adding 8 to 50 parts by weight of water to one part by weight of the ore thus calcined. The slurry is agitated in a slurry tank at 20°C to 50°C for about 0.5 to 3 hours, by blowing carbon dioxide gas ($CO_2$) at different pressures in the range of 1 to about 20 atmospheric pressures. Thereby, the magnesia in the calcined ore reacts according to the following chemical reaction, so as to dissolve magnesium thus isolated.

$$MgO + CO_2 + H_2O \rightarrow Mg^{++} + 2HCO_3^- \quad (5)$$

The slurry thus agitated is filtered at an elevated pressure. The filtrate is suddenly exposed to the atmospheric pressure or boiled, so as to generate precipitates of magnesium carbonate $MgCO_3.3H_2O$, while causing evaporation of carbon dioxide gas dissolved therein.

The operating conditions of the aforesaid separation of magnesia from starting nickel magnesium silicate ore will now be described in further detail. The starting ore is crushed, preferably to the grain size of 150 $\mu$, as pointed out in the foregoing, so as to facilitate the succeeding calcining and extracting processes.

The purpose of the calcining process is to thermally decompose the ore, so as to prepare it for the separation of magnesia MgO. In the ore, both magnesia MgO and nickel oxide are in the form of solid solution with silicate, and by the calcination, the magnesia MgO is converted into an easily extractible form and nickel is converted into an easily reducible form. The temperature for initiating the decomposition of the crystal of the nickel magnesium silicate ore, which crystal contains MgO in the form of hydrous silicate, is about 500°C, preferably 600°C. Thus, the minimum temperature for the calcination is 500°C. Magnesia MgO and silica $SiO_2$ thus separated from the crystal of the nickel magnesium silicate ore by the calcination may be recombined to form hardly separable forsterite ($2MgO.SiO_2$) if they are heated to 800°C or higher. Accordingly, the calcining temperature should be below 800°C. Therefore, the suitable range of calcining temperature is 500°C to 800°C.

Figure 2:
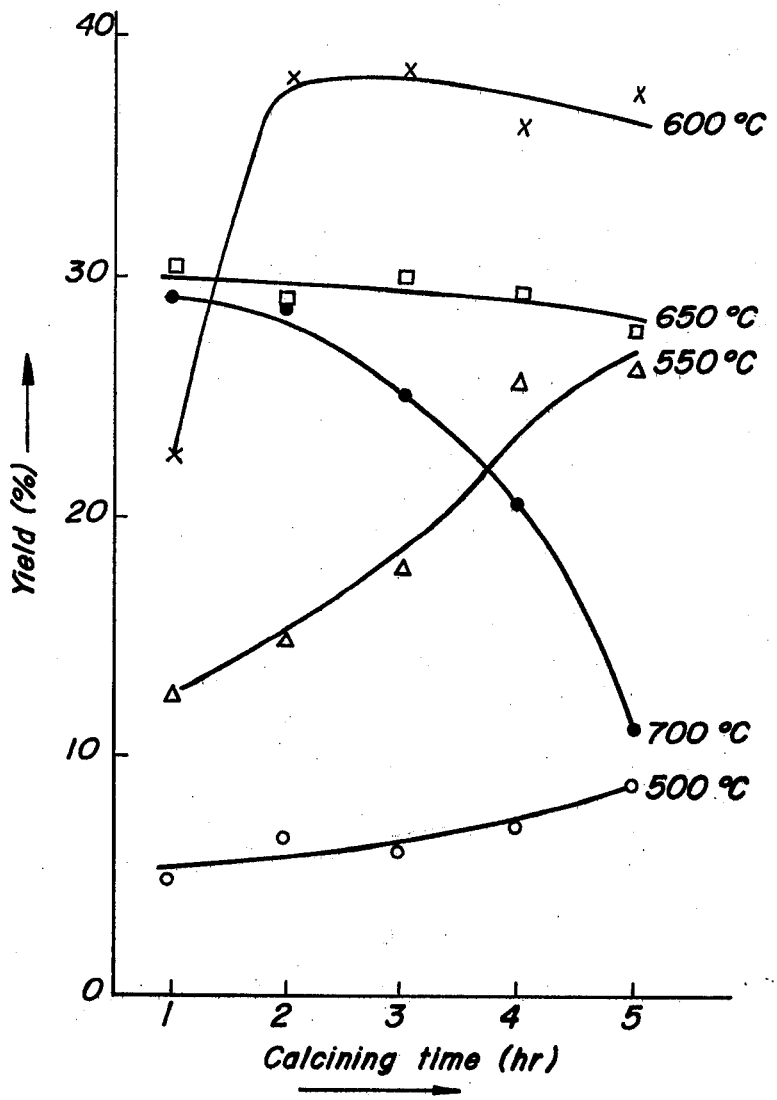
FIG. 2 is a graph showing the relation between the yield of magnesia and calcining conditions.

FIG. 2 shows the relation between the yield of magnesia and one of the calcining conditions, i.e., calcining time. The yield is expressed in terms of the percentage of the amount of MgO extracted in the form of $MgCO_3.3H_2O$ to the amount of MgO originally contained in the starting ore. Namely, $$\text{Yield} = \frac{\text{Amount of MgO extracted}}{\text{Amount of MgO originally present in the ore}} \times 100\%$$

The configuration of FIG. 2 was determined by measuring the yield for different durations of calcination, while keeping other conditions constant, such as the slurry concentration and the partial pressure of carbon dioxide gas. The ordinate represents the yield, and the abscissa represents the calcining time.

It is apparent from FIG. 2 that when the duration of calcination is about 1 hour, more than 30% of MgO yield can be achieved provided that the calcining temperature is in the range of 600°C to 700°C. The highest yield can be achieved by effecting the calcination for 2 to 3 hours at 600°C.

Figure 3:
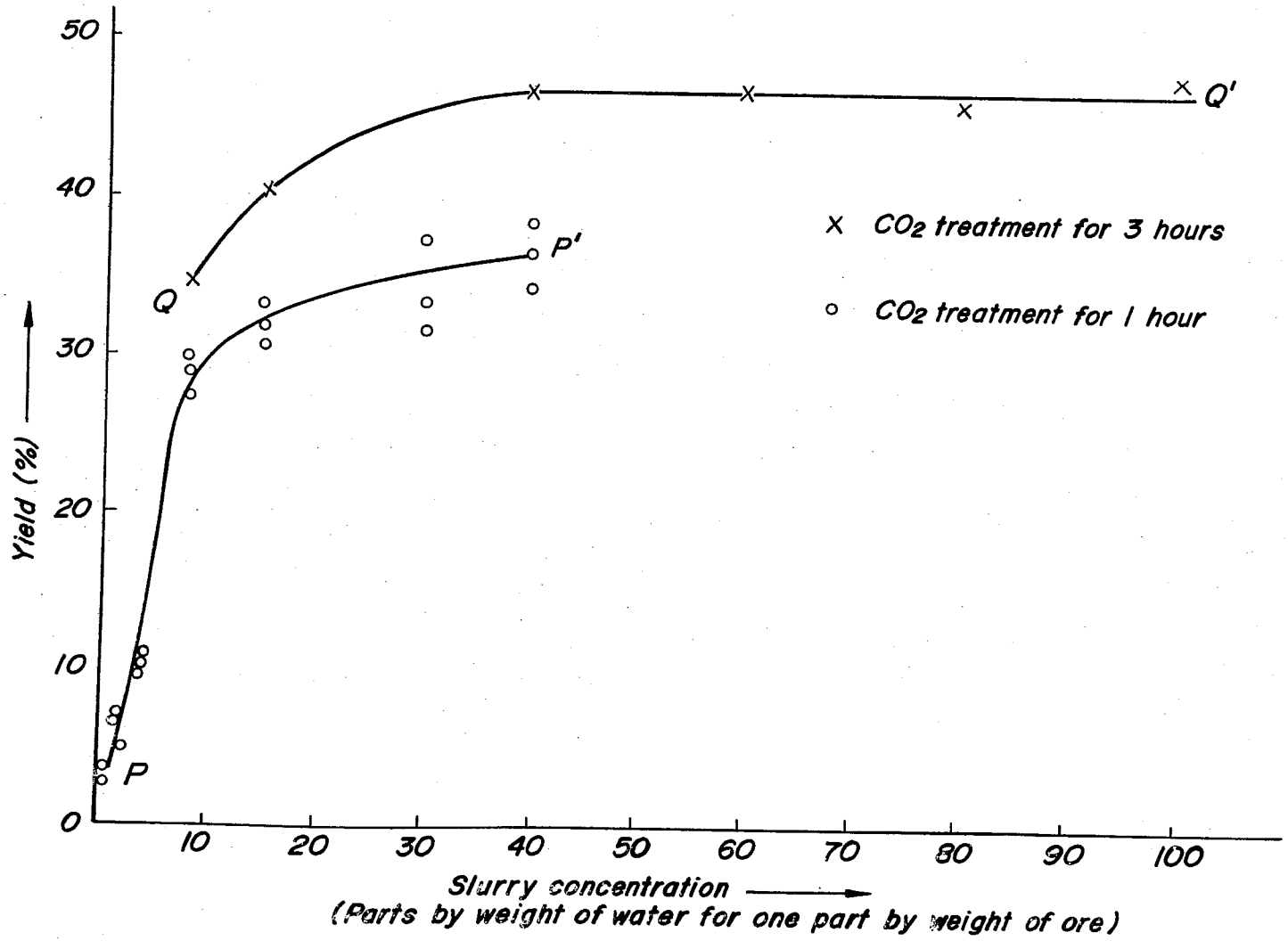
FIG. 3 is a graph, showing the relation between the yield of magnesia and the concentration of calcined ore in a slurry.

Water is added to the ore thus calcined, to prepare a slurry. The concentration of the ore in the slurry should preferably be low, because the solubility of the magnesium bicarbonate, to be generated in the next step, is abut 0.64 gram/100 cc.$H_2O$ at 35°C under the atmospheric pressure. In order to determine the inndustrially useful range of the slurry concentration, tests were made by determining the yield of magnesia for different concentrations of the calcined ore in the slurry. The quantity of water in the slurry was varied from 1 to 40 parts by weight per one part by weight of the calcined ore. Carbon dioxide ($CO_2$) gas treatment was carried out for one hour by blowing a $CO_2$ gas into slurry of 6 atmospheric pressures, at a rate of 2 liters/minute, while keeping the reaction temperature at 35°C and the results are represented by the curve P–P′ of FIG. 3. In FIG. 3, the ordinate shows the yield of magnesia, as defined in the foregoing, reference to FIG. 2.

It is apparent from the curve P–P′ of FIG. 3 that the yield of magnesia is larger than 30%, if more than 8 parts by weight of water is added to one part by weight of the ore. To check the effects of more dilute slurry, different slurry samples were prepared by adding 8 to 100 parts by weight of water in one part by weight of the ore, respectively. The yield of magnesia was determined by treating each of the slurry samples for 3 hours by blowing a $CO_2$, at a rate of 2 liters per minute, while keeping the reaction temperature at 35°C and the reaction pressure at 5 Kg/cm$^2$. The results are represented by the curve Q–Q′ of FIG. 3.

Judging from the curves P–P′ and Q–Q′ of FIG. 3, the suitable concentration of the calcined ore in the slurry is 8 to 50 parts by weight of water per one part by weight of the ore, based on reasonable duration of the carbon dioxide treatment, such as 1 to 3 hours. If the quantity of water is less than 8 parts by weight per one part by weight of the ore, the yield of magnesia is too low, while if the quantity of water exceeds 50 parts by weight per one part by weight of the ore, the yield cannot be improved although the facilities must be expanded for handling the increased quantity of water.

The slurry of the calcined ore is subjected to carbon dioxide treatment in a slurry tank by blowing a carbon-dioxide-containing gas thereto, so as to effect the chemical reaction (5). In this carbon dioxide treatment, if the reaction temperature is too low, the reaction velocity becomes too slow. On the other hand, if the reaction temperature is too high, the solubility of carbon dioxide gas is undesirably lowered. For reasonable durations of the carbon dioxide gas treatment and treating pressures, for instance, in the case of one hour treatment at the atmospheric pressure, the preferred temperature range is 20°C to 50°C.

Figure 4:
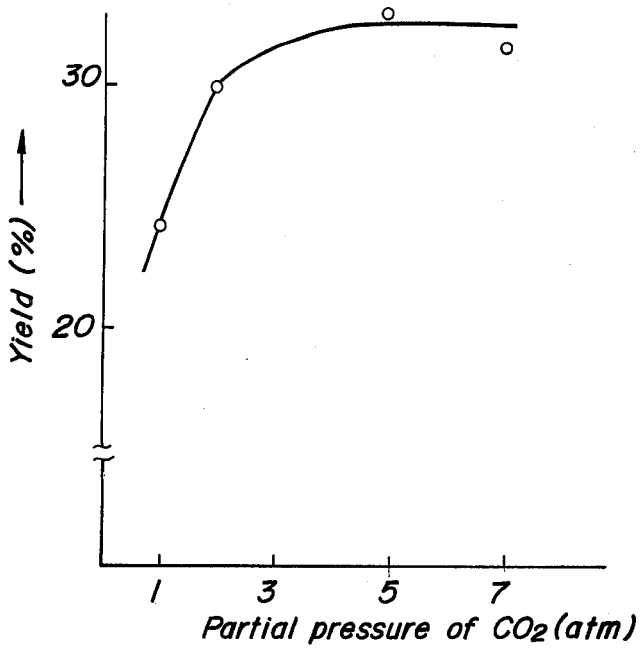
FIG. 4 is a graph, illustrating the relation between the yield of magnesia and the partial pressure of carbon dioxide in the gas blown into the slurry of calcined nickel magnesium silicate ore.

The pressure of carbon dioxide gas, or the partial pressure of $CO_2$ in the carbon-dioxide-containing gas, should be determined by considering the solubility of carbon dioxide gas in water. Generally speaking, high partial pressure of $CO_2$ is effective in improving its solubility in water and improving the yield of magnesia MgO. The effects of the partial pressure of $CO_2$ on the yield of magnesia was checked by blowing carbon-dioxide-containing gas with different partial pressures of $CO_2$ in a slurry for one hour at 50°C. The slurry was made by adding 10 parts by weight of water to one part by weight of the calcined ore. The partial pressure of $CO_2$ was varied in the range of 1 to 7 atm. The results are shown in FIG. 4.

It is apparent from the figure that the yield of magnesia increases rapidly when the partial pressure of $CO_2$ is raised from 1 atm. to about 2 atm. For the partial pressure higher than about 2 atm., the improvement of the yield in response to the raising of the partial pressure is slowed down.

In filtering the slurry thus treated, it should be noted that both the slurry before filtering and the filtrate should be kept at the same pressure level, because if the pressure of the slurry is reduced before the filtering, the magnesium ions dissolved in it at high pressure may crystallize in the form of $MgCO_3 \cdot 3H_2O$, as pointed out in the foregoing. Accordingly, in the actual slurry tank for effecting the carbon dioxide treatment, a partition means is provided to define a filtrate chamber, which is contiguous to a slurry chamber holding the slurry. The filtering process may be carried out while keeping both the slurry chamber and the filtrate chamber at the same pressure level. Therefore, the reduction of pressure of both filtrate chamber and slurry chamber may be followed after ending of filtration.

The content of silica in the residue thus prepared is considerably improved, as compared with that in the starting ore. For instance, some of the garnierite determined which were used in one of the tests made by the inventors, contained 40.62% of $SiO_2$ and 2.97% of (Ni+Co), and such contents were improved to 49.45% and 3.75%, respectively, by the aforesaid magnesium-removing treatment. Thus, excellent sources of silica are prepared, which can also be used as the source of nickel. Besides, the reducibility of nickel is greatly improved by decomposing the hydrous silicate crystals through the aforesaid calcining process.

The filtrate contains $Mg^{++}$, and as the pressure of the filtrate is changed, for instance, by exposing it to the atmosphere or by boiling it, the residual carbon dioxide gas is expelled from the filtrate to produce precipitates of $MgCO_3 \cdot 3H_2O$. One can recover magnesia from such precipitates.

The residue thus prepared (to be referred to as "silica-containing residue", hereinafter), by removing magnesia from the nickel magnesium silicate ore, is then mixed with iron-rich ore or iron-rich nickel oxide. The mixture is heated in a reducing atmosphere at a temperature high enough for generating fayalite or fayalite-foresterite solid solution, so that the reduction of nickel may be accelerated while suppressing the reduction of iron by means of the fayalite or fayalite-forsterite solid solution thus generated.

The silica-containing residue includes a sizable amount of nickel, in addition to the silica, and hence, the residue can be used both as a silica source and a nickel source.

As a result of the aforesaid reducing treatment of the iron-rich nickel ore or iron-rich nickel oxide, by using the silica-containing residue, there is produced luppe (puddled iron) containing reduced nickel. The desired ferro-nickel with a high nickel content can be obtained by crushing, and removing the fayalite or the fayalite-forsterite solid solution by a table type or wet type magnetic separator. In the magnetic separator, the iron component in the form of fayalite or fayalite-forsterite solid solution is transferred to slags, due to the non-magnetic properties of such form of the compound.

Figure 1:
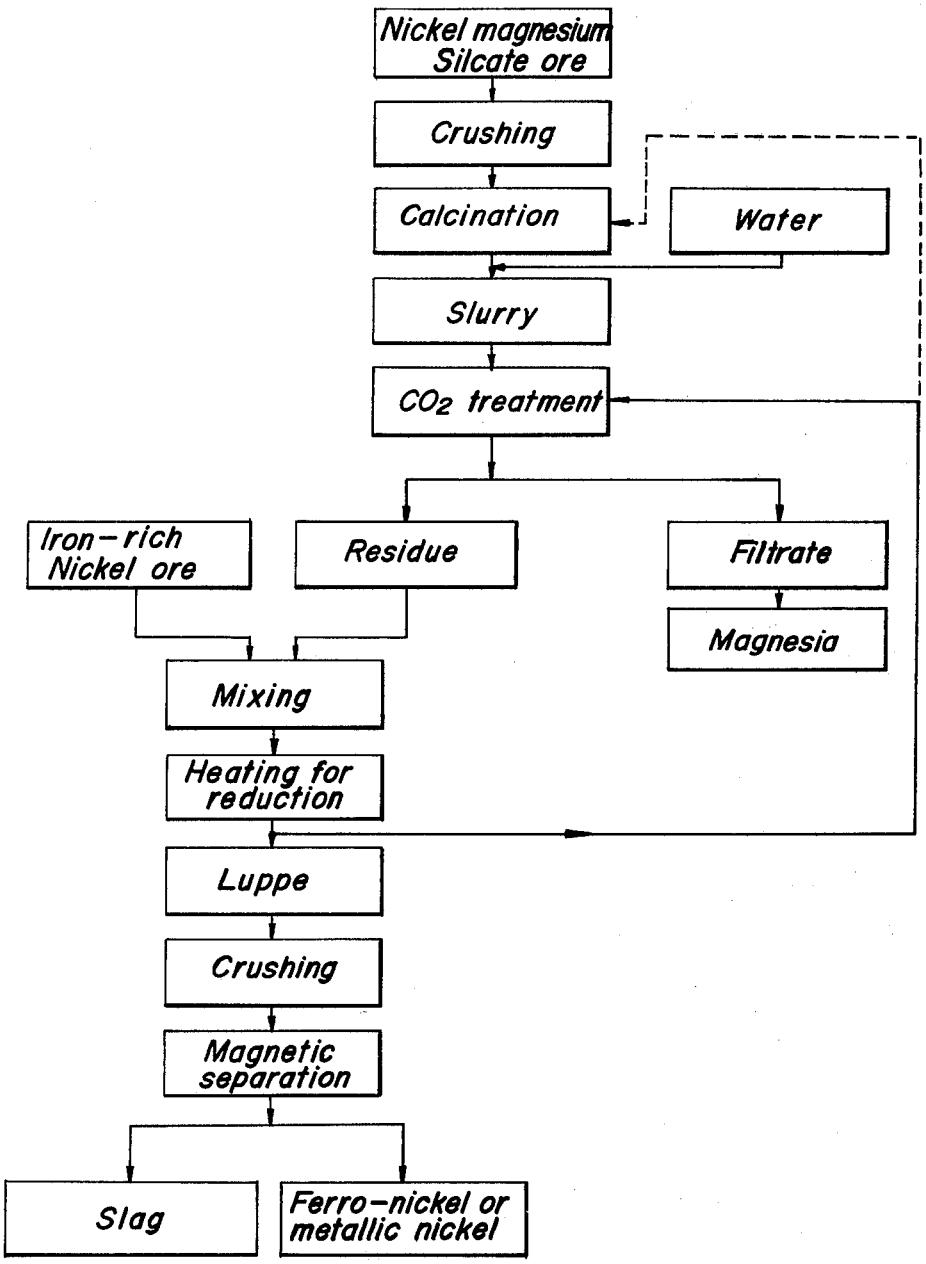

According to an important feature of the present invention, the exhaust gas from the reducing process of the reducing process of the mixture contains hot carbon dioxide gas, and such exhaust gas can advantageously be used for the separation of magnesia from the slurry of the nickel magnesium silicate ore, as shown in FIG. 1. Thereby, the overall heat efficiency of the nickel refining process according to the present invention can be kept at a high level.

It is also possible to use the hot exhaust gas from the reducing process for heating the nickel magnesium silicate ore to be calcined for the separation of magnesia. Thereby , the overall heat efficiency will further be improved.

The invention will now be described in further detail by Examples.

EXAMPLE 1

Nickel magnesium silicate ore consisting of garnierite form New Caledonia, which has a chemical composition as shown in Table 2, was crushed to a grain size finer than 150 $\mu$ and calcined at 600°C for 2 hours. A slurry was made by adding 200 cc of water in 5 grams of the ore thus calcined, and then agitated for 2 hours while blowing the exhaust gas from the reducing process, to be described hereinafter, at a rate of 1 liter/-min, under 5 atm. for dissolving carbon dioxide gas therein. The exhaust gas was 40°C and consisted of about 20% of carbon dioxide gas, and about 80% of nitrogen gas, inclusive of about 0.1% of carbon monoxide gas. The agitation was carried out at the atmospheric pressure, and the slurry thus agitated was then filtered at 5 atm. The filtrate was boiled to precipitate magnesia (MgO) in the form of magnesium carbonate. The yield of the magensia proved to be 33%.

Table 2

| Ore | Ignition loss | Composition $SiO_2$ | $Fe_2O_3$ | $Al_2O_3$ | CaO | MgO | Ni+Co |
|---|---|---|---|---|---|---|---|
| Garnierite from New Caledonia | 10.72 | 40.62 | 15.54 | 0.60 | 0.24 | 27.34 | 2.97 |

EXAMPLE 2

A sample was prepared by mixing 80% of iron-rich nickel ore consisting of laterite from New Caledonia, which has a chemical composition as shown in Table 3, and 20% of 99.6% pure silica. The sample thus prepared was reduced for 1.5 hour in a test furnace at different temperatures, i.e., 800°C, 1,000°C, and 1,200°C, respectively. The concentration of the carbon monoxide in the reducing atmosphere, as defined by $$\left(\frac{CO}{CO + CO_2}\right)$$

was 80% during the reduction.

Table 3

| Ore | Ignition loss | Composition Fe | Ni | $SiO_2$ | $Al_2O_3$ | CaO | MgO |
|---|---|---|---|---|---|---|---|
| Laterite from New Caledonia | 11.58 | 50.45 | 1.41 | 3.18 | 4.48 | 0.43 | 1.28 |

For making a comparison, the iron-rich nickel ore having a chemical composition of Table 3 was reduced in the same manner as described above, but without adding any silica therein; namely, the same reducing conditions, inclusive of temperature, carbon monoxide concentration, and reducing time, were used in the same test furnace for the latter test reduction.

In these tests, the following degree of reduction R was determined for each of the samples, which were treated at different temperatures.

$$R = \frac{\text{(Decrease in the amount of oxygen by the reduction)}}{\text{(Amount of oxygen combined with iron or nickel before the reduction)}} \times 100\%$$

The above degree of reduction R corresponds to the commonly used deoxidation ratio.

The formation of fayalite was confirmed by using X-ray diffraction diagrams. For this purpose, an X-ray diffraction diagram of standard fayalite was separately prepared, and the X-ray diffraction diagram of the actual samples were compared with the standard diagram for checking the formation and the presence of fayalite.

Figure 6:
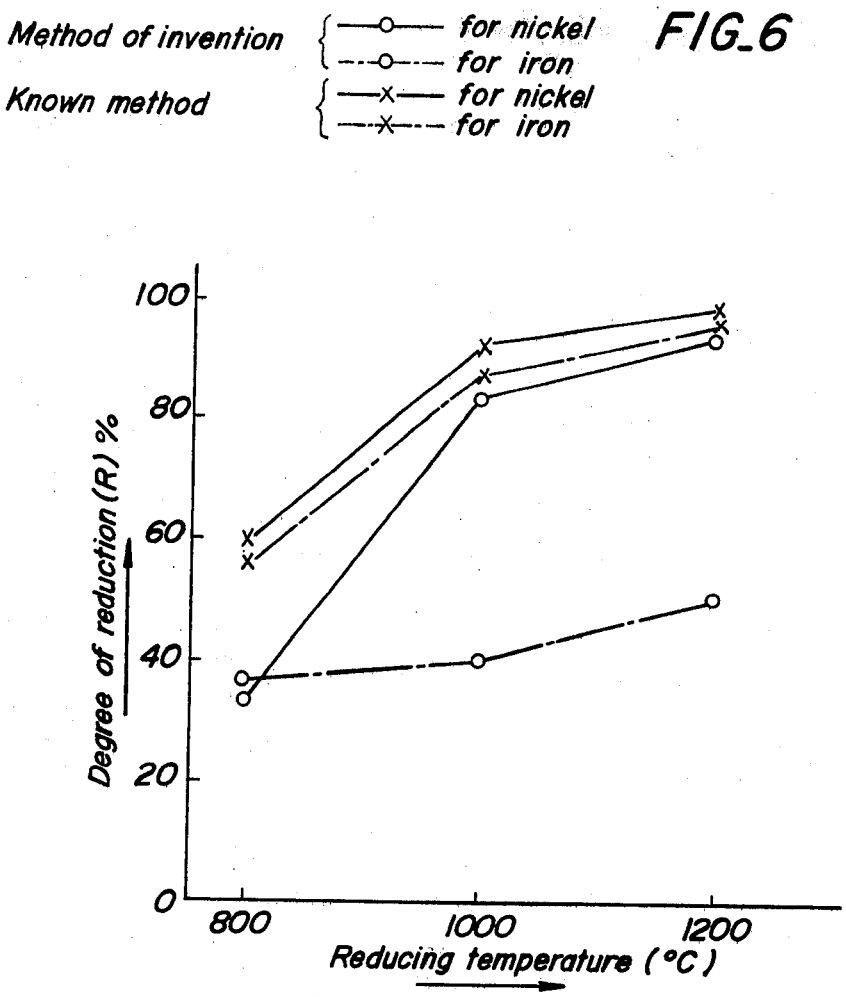
FIG. 6 is a graph, illustrating the relation between the degree of reduction and temperature in the reducing process, according to the present invention.

The samples treated by the method of the present invention and the conventional method were analysed, and the degree of reduction R, as defined above, was deterined for each of the samples thus treated, and the results are shown in FIG. 6.

It is apparent from FIG. 6 that, with the conventional method, the iron oxides and nickel oxides of the ore are simultaneously reduced to produce metallic iron and metallic nickel. Especially, when the ore is treated at 1,200°C by the conventional method, there are no $Fe^{+++}$ and $Fe^{++}$ ions left in the final products, so that most of the iron contained in the starting ore is reduced to metallic iron. On the other hand, with the method of the present invention, iron oxides in the starting ore are hardly reduced, while nickel oxides therein are reduced at an increased rate.

Accordingly, with the method of the present invention, low grade iron-rich nickel ore, which has heretofore been regarded as uneconomical for refining, can be used for the manufacture of high grade ferro-nickel. For instance, laterite can be used as the starting material of nickel making, according to the present invention.

Figure 7:
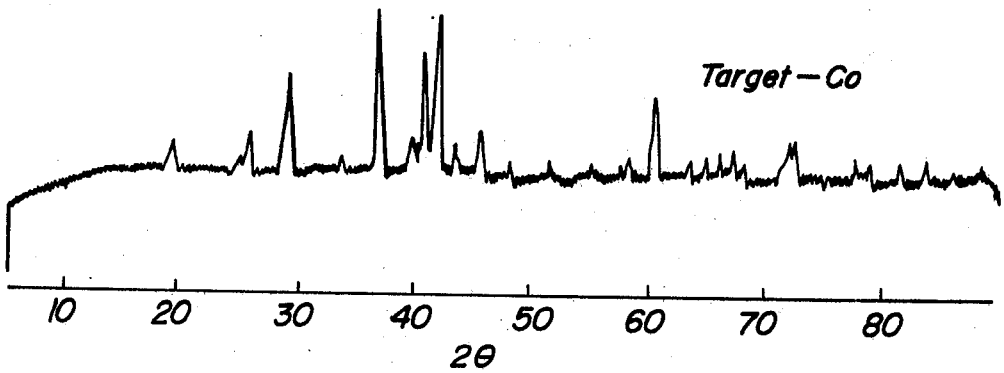
FIG. 7 is an X-ray diffraction diagram of typical fayalite.
Figure 8:
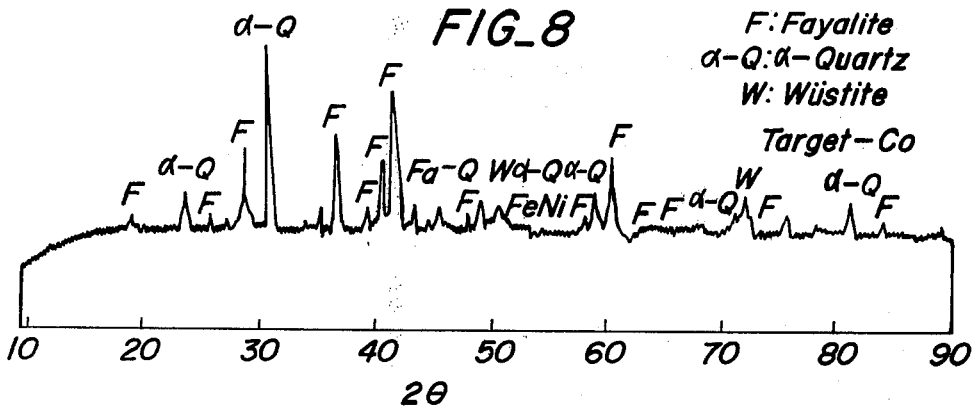
FIG. 8 is an X-ray diffraction diagram of products from an embodiment of the present invention.

As a reference for checking the formation of fayalite, an X-ray diffraction diagram of standard fayalite was taken, as shown in FIG. 7. Similarly, another X-ray diffraction diagram was taken for the sample being treated at 1,000°C according to the present invention, as shown in FIG. 8. In comparing FIGS. 7 and 8, it is apparent that fayalite was formed by the method of the present invention, for suppressing the reduction of iron.

EXAMPLE 3

Nickel magnesium silicate ore with the composition of Table 2 was crushed to a grain size finer than 150 $\mu$, and then calcined at 600°C for 2 hours, in the same manner as Example 1. A slurry was made by adding 40 parts by weight of water to one part by weight of the ore thus calcined. The slurry thus prepared was agitated for one hour by blowing the exhaust gas from the reducing process to be described hereinafter, at a pressure of 10 atm. (gauge pressure). The slurry thus agitated was filtered by using a filter cloth, while keeping the slurry tank at 10 atm. and the filtrate chamber pressure at 8.5 to 9 atm.

The yield of MgO in this process was about 43%, and the yield of NiO was 2.4%. The chemical composition of the silica-containing residue was determined, as shown in Table 4.

Table 4

| Material | Ignition loss | Composition (%) $SiO_2$ | $Fe_2O_3$ | $Al_2O_3$ | CaO | MgO | Ni+Co |
|---|---|---|---|---|---|---|---|
| Silica-containing residue | 5.64 | 49.45 | 18.95 | 0.74 | 0.30 | 19.19 | 3.57 |

A mixture was made by adding 140 parts by weight of iron-rich nickel ore (laterite from New Caledonia), with the composition of Table 3, into 100 parts by weight of the silica-containing residue with the composition of Table 4. The composition of the mixture thus prepared was determined as shown in Table 5.

Table 5

| Material | Iron Fe | Nickel Ni | Silica $SiO_2$ | Magnesia MgO | Calcium oxide CaO | Alumina $Al_2O_3$ | Ignition loss |
|---|---|---|---|---|---|---|---|
| | Composition (%) | | | | | | |
| Mixture of iron-rich ore and silica-containing residue | 35.66 | 2.19 | 21.22 | 8.25 | trace | 2.97 | 8.58 |

The mixture of the iron-rich nickel ore and the silica-containing residue thus prepared contained magnesia, as shown in Table 5, and the magnesia forms forsterite ($2MgO.SiO_2$) during the reducing process, as pointed out in the foregoing. This forsterite reacts with fayalite and forms fayalite-forsterite solid solution. Accordingly, not all the silica in the mixture, as shown in Table 5, is available for the formation of fayalite. It is calculated that only 15.07% of the silica, based on the total mixture, is available for the formation of fayalite, and about 27% of iron, based on the total mixture, can be fixed by such silica.

The mixture was reduced at different temperatures, i.e., 600°C, 800°C, 1,000°C, 1,200°C, and 1,300°C, for 1.5 hours, respectively. The reducing process was carried out in a test furnace by adding 5% of coke as a reducing agent, while blowing argon gas therethrough.

For the sake of comparison, similar reducing process was carried out by using pure carbon monoxide gas, instead of the coke acting as a solid reducing agent. In this case, the reducing time was also 1.5 hour.

For further comparison, the iron-rich nickel ore with the composition of Table 3 and the silica-containing residue with the composition of Table 4 were separately reduced without mixing together. The conditions of the reducing process were the same as those for the reduction of the mixture, and both coke and pure carbon monoxide gas were used as the reducing agent for the separate reducing processes of the iron-rich nickel ore and the silica-containing residue, respectively.

Figure 9:
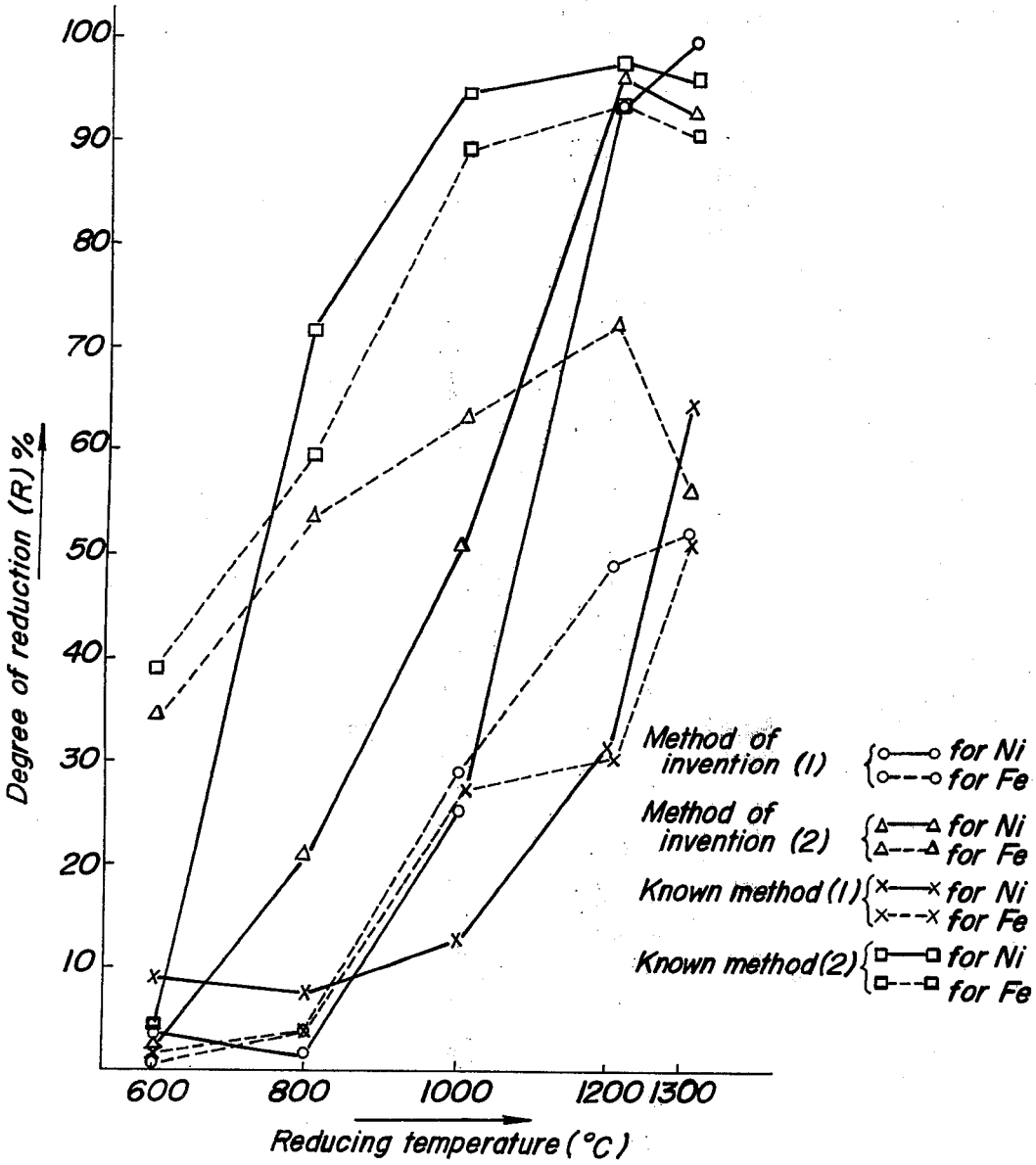
FIG. 9 is a graph, illustrating the relations between the degree of reduction of nickel and iron and the reducing temperature.

The results are shown in Table 6, and the relation between the reducing temperature and the degree of reduction is shown in FIG. 9.

Table 6

| Method | Sample | Reducing temperature (°C) | Metallic iron (%) | Metallic nickel (%) |
|---|---|---|---|---|
| Method of the invention (1) | Mixture of the ore and the residue. Reducing agent: coke (argon atmosphere) | 600 | 0.16 | 0.07 |
| | | 800 | 0.18 | 0.04 |
| | | 1,000 | 0.94 | 0.62 |
| | | 1,200 | 12.29 | 2.41 |
| | | 1,300 | 14.35 | 2.61 |
| Method of the invention (2) | Mixture of the ore and the residue. Reducing agent: Pure CO gas | 600 | 2.09 | 0.07 |
| | | 800 | 16.31 | 0.55 |
| | | 1,000 | 23.31 | 1.40 |
| | | 1,200 | 32.01 | 2.66 |
| | | 1,300 | 16.95 | 2.64 |
| Known method (1) | The silica-containing residue. Reducing agent: coke (argon atmosphere) | 600 | 0.25 | 0.27 |
| | | 800 | 0.06 | 0.24 |
| | | 1,000 | 0.31 | 0.42 |
| | | 1,200 | 1.85 | 1.11 |
| | | 1,300 | 7.43 | 2.35 |
| Known method (2) | The iron-rich nickel ore (laterite) Reducing agent: Pure CO gas | 600 | 5.58 | 0.42 |
| | | 800 | 35.80 | 1.21 |
| | | 1,000 | 72.53 | 1.72 |
| | | 1,200 | 75.04 | 1.94 |
| | | 1,300 | 73.21 | 2.02 |

The reducing process (1) of the present invention in Table 6 uses coke and argon atmosphere for constituting the reducing atmosphere, while the reducing process (2) of the present invention in Table 6 uses pure carbon monoxide gas for such purposes. The equilibrium diagram of FIG. 5 does not show such gaseous atmosphere for the reduction. Such reducing gases were used, because the materials being reduced in the actual Examples were not pure compounds, while the equilibrium diagram of FIG. 5 is based on pure compounds, and the gap between the actual complicated compounds and the pure compounds assumed in FIG. 5 should somehow be filled. In additon, the use of argon atmosphere makes up for the instability of carbon monoxide gas and the consumption of the carbon monoxide gas by the reducing reactions.

In this Example, comparatively strongly reductive atmosphere was actually used, due to the last mentioned reasons. The formation of fayalite is not disturbed by such strong reducing nature of the atmosphere, because a wide range of reducing gas concentration is allowed for the formation of fayalite, as pointed out in the foregoing.

If the reducing temperature is higher than 1,400°C, fayalite may be reduced by solid carbon as in the case of a blast furnace for pig iron. Thus, for the reduction at 1,400°C or higher, the amount of carbon to be added must be limited to the bare minimium, which is necessary for the reduction of iron and nickel.

It is apparent from Table 6 and FIG. 9 that the degree of reduction of iron and the amount of metallic iron in reducing process of the present invention are reduced as compared with those of the known method (2). The difference in the amount of metallic iron increases when the reducing temperature exceeds 1,000°C, at which the formation of fayalite and fayalite-forsterite solid solution begins. Such difference in the amount of metallic iron indicates the effectiveness of the presence of fayalite for suppression of the reduction of iron, or for fixation of iron. In other words, the reduction of iron can be controlled by the use of fayalite. In fact, the control or iron reduction by fayalite is more reliable and accurate than by mere regulation of the reducing atmosphere.

As regards the reduction of nickel, it is apparent from the comparison of the methods (1), (2) of the present invention with the known methods (1), (2) that the nickel reduction is not affected by the presence of fayalite and fayalite-forsterite solid solution. Furthermore, the rate of metallic nickel production in the method of the invention is superior to that of the known method (1), even at an elevated temperature. This improvement in the degree of nickel reduction is due to the fact that the reduced nickel forms a solid solution with metallic iron to reduce its activity, and that the formation of fayalite by using iron contained in the ore accelerates the breakdown of crystalline structure of nickel magnesium silicate ores, e.g., garnierite.

The use of fayalite for the control of iron reduction is not only a feature of the present invention but also the finding of the inventors, on which the present invention is based.

Inspection of the sample metal prepared by the method of the present invention indicated that nickel was in the form of very fine particles of diameter of about one micron. Such fact means that the addition of silica in iron-rich nickel ore, such as laterite, was highly effective in the production of fine metallic nickel particles.

In FIG. 9, it is noticed that the degree of reduction of iron and nickel in the method (2) of the present invention was lowered at 1,300°C. This decrease in the reduction is due to the fact that the ores being treated was in a semi-molten state, and the permeation of reducing gas was restrained.

Figure 10:
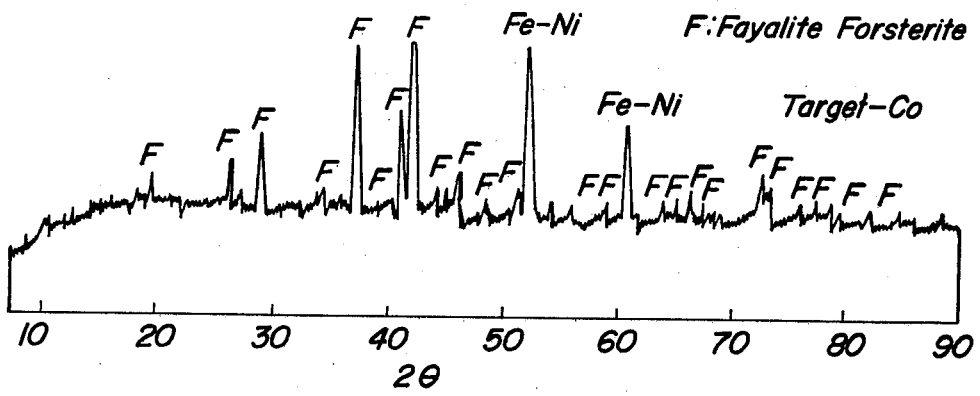
FIG. 10 is an X-ray diffraction diagram of products formed in a different embodiment of the present invention.

An X-ray diffraction diagram was prepared for the sample, which was treated by the method (2) of the present invention at 1,200°C. The result is shown in FIG. 10. The comparison of FIG. 10 with FIG. 7 clearly indicates that fayalite and fayalite-forsterite solid solution were generated in the sample being treated by the method of the present invention.

EXAMPLE 4

A starting material mixture was prepared by using laterite and garnierite from New Caledonia at a ratio of 7:3. The chemical compositions of the laterite and garnierite are shown in Table 7.

Table 7

| Ore | Ignition loss | Composition Fe | Ni | $SiO_2$ | $Al_2O_3$ | CaO | MgO |
|---|---|---|---|---|---|---|---|
| Laterite | 12.05 | 45.59 | 1.33 | 11.54 | 3.89 | 0.07 | 2.19 |
| Garnierite | 8.51 | 13.60 | 2.02 | 46.65 | 2.44 | 0.56 | 17.18 |

To use as a source of silica, garnierite having a high silica content was selected. The mixture was prepared by using 2,000 tons of the laterite. After weighing, the mixture was crushed by a hammer crusher and a wet-type ball mill to form a slurry, which is stored in a slurry tank. The slurry was fed into a rotary kiln at a rate of 3 tons/hour, while reducing its moisture content by a filter. At the same time anthracite was added in the kiln as a carboneous reductant, at a rate of 12%.

Figure 11:
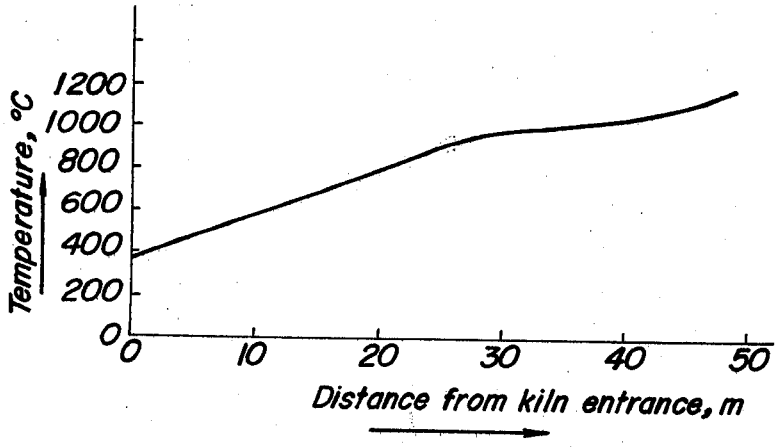
FIG. 11 is a graph showing temperature distribution in a rotary kiln for effecting the method of the present invention.

The rotary kiln was 50 meter long and had a diameter of 2.5 meters, and it was turned at a speed of 60 revolutions per hour. The temperature in the rotary kiln was controlled by regulating air flow thereto and the revolving speed thereof, so as to provide a suitable temperature distribution, as shown in FIG. 11. Whereby, the desired temperature range of 900°C to 1,300°C was obtained over a range of about 20 meters in length, and the materials being treated were kept in this temperature range for 2 to 3 hours.

The treatment of the starting materials at this temperature range for such a long time has a critical importance in the method according to the present invention, as pointed out in the foregoing.

It was confirmed by tests that the materials thus treated in the rotary kiln contained fayalite which was produced therein. The mean reducing rates of iron and nickel were about 18% and 70%, respectively.

The fired materials from the rotary kiln were directly fed into a spindle-shaped reverberatory furnace, so as to separate the nickel thus produced. The direct feeding of the fired materials into the furnace resulted in a high heat economy, because it eliminated heat loss due to the cooling of the fired materials and the reheating of the same in the furnace. The spindle-shaped reverberatory furnace was 15 meter long and had a diameter of 4 meters. The diameters at the opposite ends were 2 meters, respectively. The reverberatory furnace was capable of melting and holding about 20 tons of material while turning it. A burner was attached to the furnace, which burnt heavy oil at a maximum rate of 1,300 liters/hour. In every six hours, about 20 tons of the fired material was melted, and a tap hole located at the central portion of the furnace opened for delivering slag and the molten metal. The average temperature of the tapped metal was about 1,500°C.

The chemical compositions of the metal and the slag thus tapped were analyzed. The results are shown in Tables 8 and 9.

Table 8

| Ni(%) | S(%) | P(%) | C(%) | Fe |
|---|---|---|---|---|
| 33.65 | 0.36 | 0.004 | 0.01 | Balance |

Table 9

| $SiO_2$(%) | Fe(%) | $Al_2O_3$(%) | CaO(%) | MgO(%) | Ni |
|---|---|---|---|---|---|
| 35.45 | 32.41 | 3.46 | 2.13 | 15.14 | 0.11 |

As apparent from Table 8, the nickel content 33.65% in the final product according to the present invention was considerably higher than that of the aforesaid Greene (U.S. Pat. No. 2,767,075), which was at most 6%. The nickel content which is obtained by the method of the invention is also about 50% better than the aforesaid Strategic-Udy process.

EXAMPLE 5

A starting mixture was prepared, which consisted of 100 parts of laterite of Table 7, 15 parts of 98%-pure quartz sand, and 8.5 parts of anthracite. The starting mixture was crushed, and then 0.5% to 5% of sodium carbonate and 0.5% to 5% of sodium chloride were added into different sample of the crushed material. The samples of the mixture thus prepared were fired in a test electric furnace of small size at different temperatures in a range of 900°C to 1,300°C. The firing lasted for 1 hour at each temperature.

Figure 12:
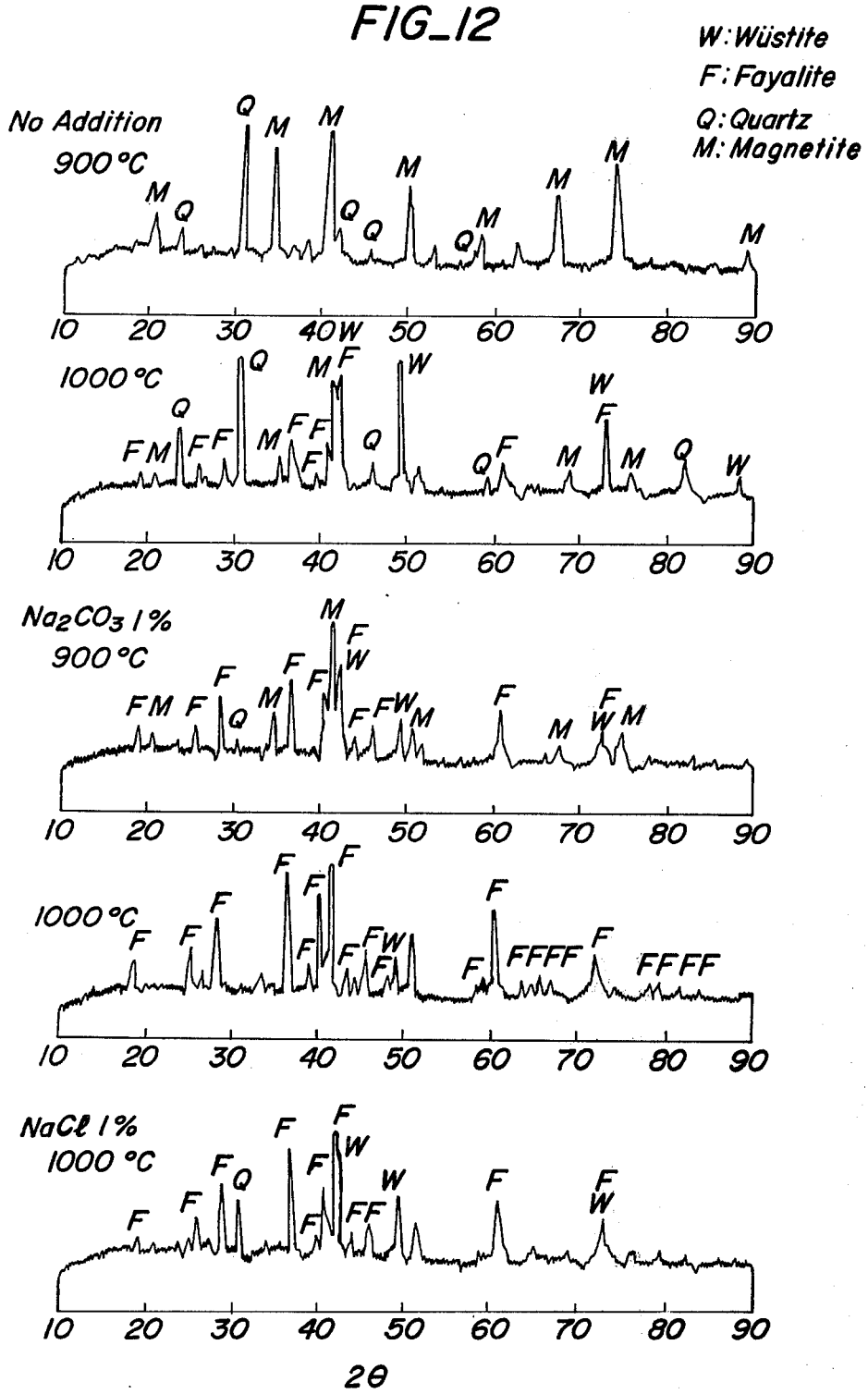
FIG. 12 is an X-ray diffraction diagram, illustrating the acceleration of the fayalite formation by addition of sodium carbonate or sodium chloride.

To check the fayalite formation, the fired products were tested by X-ray diffraction. The result is shown in FIG. 12. It is apparent from FIG. 12 that the fired products which contained sodium carbonate or sodium chloride had more peaks for fayalite intensity and less peaks for quartz intensity, as compared with the corresponding products without such sodium compounds. Thus, the addition of sodium carbonate and/or sodium chloride accelerates the formation of fayalite.

The inventors have confirmed through tests that, when more than 0.5% of sodium carbonate and/or sodium chloride is added, the formation of fayalite can be accelerated by firing at 900°C or higher, but the addition of less than 0.5% of such salts does not provide the desired acceleration of fayalite formation. On the other hand, if more than 5% of sodium carbonate and/or sodium chloride is added, the melting point of the starting mixture becomes too low to ensure the firing at 1,300°C or below for the fayalite formation.

As a result, the addition of sodium carbonate and/or sodium chloride should be effected in a range of 0.5% to 5%, based on the total amount of the starting materials.

The effects of the method of the present invention may be summarized as follows:

1. The calcination of nickel magnesium silicate ore at 500°C to 800°C results in the separation of water of crystallization in the silicate, so as to breakdown the crystal structure of magnesium silicate. As a result, magnesia is separated, and nickel is activated, so that magnesia can easily be removed and the yield of metallic nickel in the next succeeding step can be improved.
2. The carbon dioxide gas treatment and filtration of the slurry made by adding water in the calcined ores results in the separation of magnesia and silica-containing residue. As a result, all the components of garnierite ores, inclusive of magnesia, silicate, and nickel, can be fully utilized.
3. The reduction of nickel while suppressing the iron reduction, according to the present invention, is established in that iron-rich nickel oxide or iron-rich nickel ore is mixed with silica-containing residue after the removal of magnesia from nickel magnesium silicate ore, and that the mixture is heated at a temperature high enough for the formation of fayalite in an atmosphere containing carbon monoxide and carbon dioxide under the conditions of $$\left(\frac{CO}{CO + CO_2}\right)$$

being 1.6 to 90%, so that the formation of fayalite may be used for the suppression of iron reduction. Consequently, the following features can be achieved.

a. Iron-rich low grade nickel ore can be used for producing high grade ferro-nickel or metallic nickel at a high yield.
   b. Reducing atmosphere of wide composition range can be used, in solid, liquid, or gas phase. Thus, the operation is easy.
   c. The silica-containing residue from the separation of magnesia from nickel magnesium silicate ore usually contains nickel, and the addition of such silica-containing residue in iron-rich ore or iron-rich nickel oxide results in the increase in the absolute amount of nickel available for nickel reduction, as compared with the corresponding amount when pure silica is added instead of the residue.
4. The exhaust gas from the nickel reducing process can be used for the separation of magnesia in the slurry. The overall heat efficiency is improved, resulting in a reduced cost of magnesia.
5. The exhaust gas from the nickel reducing step can also be fedback for the calcination step in the flow sheet of FIG. 1, as shown in dotted line, whereby the overall heat efficiency of the nickel-refining process is considerably improved.

We claim:

1. A method of refining nickel by reducing iron-rich starting material containing nickel which is substantially free from silica, comprising mixing said starting material with silica which is substantially free from magnesium and carboneous reducing agent in a reaction vessel to form a mixture containing at least about 13% silica, heating said mixture so as to produce a reducing atmosphere in said vessel comprising carbon dioxide and carbon monoxide in a ratio of $$\left(\frac{CO}{CO + CO_2}\right)$$

of 1.6% to 90%, firing said mixture at 900° to 1,300° C without melting said mixture thereby causing the iron in said starting material to compound with said silica to form difficulty reducible fayalite and the nickel in said starting material to be selectively reduced to crude nickel, cooling and crushing the cooled fired mixture and separating said crude nickel from the crushed fired mixture to recover said crude nickel.

2. A method according to claim 1 and further comprising a step of crushing the fired mixture upon cooling, and separating the crude nickel by magnetic separation.

3. A method according to claim 1 and further comprising a step of crushing the fired mixture upon cooling, and separating the crude nickel based on difference of specific gravity thereof from those of other ingredients of the fired mixture.

4. A method according to claim 1 and further comprising a step of melting the fired mixture in a furnace, so as to separate the crude nickel based on the difference of specific gravity thereof from those of other ingredients thereof.

5. A method according to claim 1, wherein 0.5% to 5% of at least one compound selected from the group consisting of sodium carbonate and sodium chloride is added in the starting mixture, said compound accelerating the formation of the fayalite.

6. A method according to claim 1 wherein said silica is substantially follows. silica or a silica-containing ore.

7. A method according to claim 1 wherein said mixture contains at least about 15% silica.

8. A method according to claim 1 wherein said iron-rich starting material is laterite.

* * * * *